US005366106A

United States Patent [19]

Kahl

[11] Patent Number: 5,366,106

[45] Date of Patent: Nov. 22, 1994

[54] LUNCHBOX

[75] Inventor: W. Henry Kahl, Wooster, Ohio

[73] Assignee: Rubbermaid Inc., Wooster, Ohio

[21] Appl. No.: 986,604

[22] Filed: Dec. 7, 1992

[51] Int. Cl.[5] ..... B65D 43/16

[52] U.S. Cl. ..... 220/555; 206/549; 220/324; 220/338; 220/756

[58] Field of Search ..... 206/541–549; 220/315, 324, 326, 334, 335, 337, 338, 340, 342–344, 553, 555, 756, 769, 773

[56] References Cited

U.S. PATENT DOCUMENTS

| | | | |
|---|---|---|---|
| 1,046,016 | 12/1912 | Ray | 220/334 |
| 1,093,110 | 4/1914 | Christopher | 206/541 |
| 1,233,206 | 7/1917 | Eibel | 220/334 |
| 1,669,399 | 5/1928 | Tronick | 190/19 |
| 1,867,455 | 7/1932 | Humphrey | 206/544 |
| 2,547,459 | 4/1951 | Green | 220/324 |
| 3,181,726 | 5/1965 | Parker | 220/324 |
| 3,317,097 | 5/1967 | Giordano | 220/324 |
| 4,802,605 | 2/1989 | Salmon et al. | 220/338 |
| 5,051,725 | 9/1991 | Caccitolo | 220/334 |

FOREIGN PATENT DOCUMENTS

| | | | |
|---|---|---|---|
| 0448639 | 5/1948 | Canada | 220/756 |
| 2173774 | 10/1986 | United Kingdom | 220/337 |

OTHER PUBLICATIONS

Bee Plastics Corp., 2660 N. Clybourn Avenue, Chicago, IL 60614, 1979, 1 page advertisement, no class.

Thermos, Route 75, Freeport, IL 61032, 1989, 1 page advertisement, no class.

Igloo Products Corp., P.O. Box 19322, Houston, TX 77224–9322, 1990 1 page advertisement, no class.

Rubbermaid Incorporated, Specialty Products Division, Wooster, OH 44691, 1991, 1 page advertisement, no class.

*Primary Examiner*—Jimmy G. Foster

*Attorney, Agent, or Firm*—Renner, Kenner, Greive, Bobak, Taylor & Weber

[57] ABSTRACT

A container shown in the form of a lunchbox (10) includes a base container portion (11) and a cover portion (12). The cover portion (12) includes a first door (17) pivotally attached to the base container portion (11) by a first hinge assembly (19) and a second door (18) is pivotally attached to the base container portion (11) by a second hinge assembly (20). Latch assemblies (37) pivotally attached to the base container portion (11) engage the doors (17, 18) so that the doors (17, 18) may be maintained closed on the base container portion (11). A handle member (44) is carried by at least one of the hinge assemblies (19, 20) for rotation relative to the base container portion (11). Tabs (57, 58, 59) may also be provided to confine an accessory within the base container portion (11).

23 Claims, 3 Drawing Sheets

LUNCHBOX

TECHNICAL FIELD

This invention relates to a container such as a lunchbox. More specifically, this invention relates to a lunchbox which is elongate in configuration having two doors latched at the center of the lunchbox, at least one of the doors having a hinge arrangement which also accommodates a handle.

BACKGROUND ART

Over the years containers specially designed as lunchboxes have taken on a number of configurations. Most typically, such lunchboxes include a base container portion having generally vertical end walls and side walls extending upwardly from a bottom surface and forming an open container. A cover is usually hinged to one of the side walls and latched to the opposed side wall. A separate handle is usually mounted on the side wall to which the cover is latched so that the lunchbox may be carried with the side wall having the hinge forming the bottom surface of the lunchbox being so carried.

Although such lunchboxes have been a mainstay for many years, they are not without need of improvement. For example, should the cover inadvertently become unlatched while the lunchboxes of the prior art are being carried, more often than not the cover will swing open spilling the contents thereof. Moreover, the cover, which can rotate on its hinge to 180° or more, takes up significant space when open, and does not at all assist in maintaining the contents of the lunchbox therein. In addition, the separately mounted handle and cover hinge results in the addition of a multiplicity of parts thereby increasing the manufacturing costs. Thus, the need exists for an improved lunchbox directed to these problems.

DISCLOSURE OF THE INVENTION

It is thus an object of the present invention to provide a container, such as a lunchbox, which has a two door cover which will not open even if it becomes unlatched.

It is another object of the present invention to provide a lunchbox, as above, in which the doors of the cover are hinged at opposed ends of the container and a handle is integrally associated with at least one of the hinges, thereby reducing the number of parts and the concomitant manufacturing costs.

It is a further object of the present invention to provide a lunchbox, as above, with a cover system which, when open, takes up no additional space and which can also assist in confining items in the lunchbox.

It is an additional object of the present invention to provide a lunchbox, as above, which is internally provided with a mechanism to hold accessories therein.

These and other objects of the present invention as well as the advantages thereof over existing prior art forms, which will become apparent from the description of preferred embodiment to follow, are accomplished by the improvements hereinafter described and claimed.

In general, a container, such as a lunchbox or the like, made in accordance with the present invention includes a base container portion and a cover portion. The base container portion has a bottom surface with side walls extending generally laterally from the bottom surface to form an opening for the container which is closed by the cover portion. The cover portion preferably includes a first door and a second door. A first hinge assembly attaches one end of the first door to one end of the side walls of the base container portion for rotation of the first door relative to the side walls. A second hinge assembly attaches one end of the second door to the other end of the side walls for rotation of the second door relative to the side walls. A latch assembly has one end pivotally mounted on the side walls and the other end thereof engages lug members positioned near the other end of the first and second doors so that the cover portion can be maintained closed on the base container portion.

In accordance with other aspects of the present invention, a handle member is carried by at least one of the hinge assemblies for rotation relative to the side walls of the base container portion and relative to the door associated with the hinge assembly. In addition, an accessory may be confined within the base container portion by a plurality of properly positioned tabs carried by the bottom surface of the base container portion and by at least one of the doors.

A preferred exemplary container, such as a lunchbox, incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
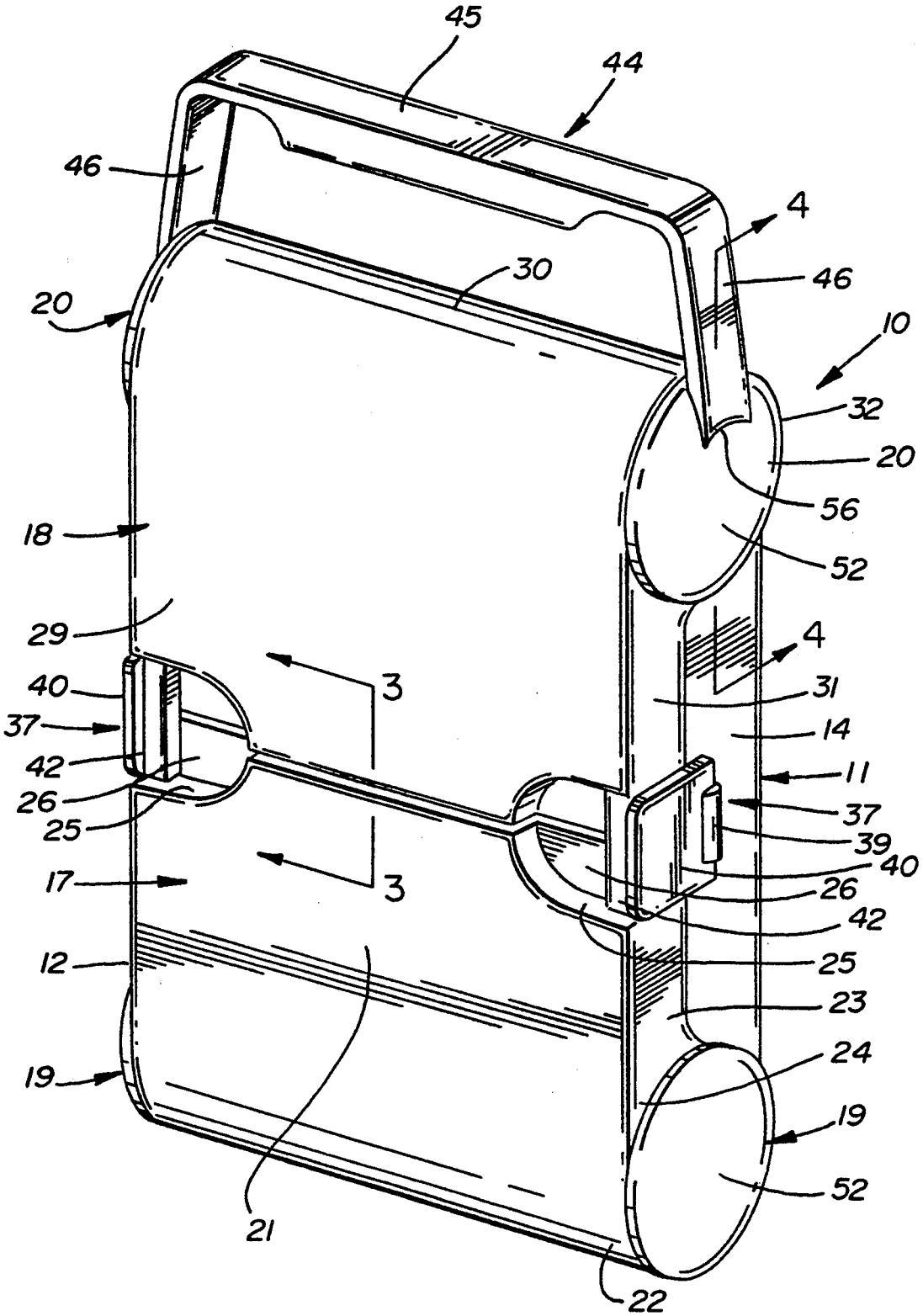
FIG. 1 is a perspective view of a container in the form of a lunchbox made in accordance with the concepts of the present invention.

A container, preferably designed to be used as a lunchbox and made in accordance with the present invention, is indicated generally by the numeral 10 and includes a base container portion indicated generally by the numeral 11, and a cover portion indicated generally by the numeral 12. Lunchbox 10 and the components thereof are preferably injection molded out of any suitable plastic material such as polypropylene.

Base container portion 11 includes a bottom surface 13 having opposed side walls 14 extending generally laterally upward therefrom. The ends 15 of side walls 14 are generally semicircular in configuration to complement the curvature of opposed arcuate end walls 16 which extend upwardly from the ends of bottom surface 13. Thus, base container portion 11 can hold materials stored in lunchbox 10, the materials being laterally confined therein by side walls 14 and end walls 16.

Cover portion 12 preferably includes two doors generally indicated by the numerals 17 and 18, each being rotatably affixed to the ends of side walls 14 by hinge assemblies generally indicated by the numerals 19 and 20, respectively. Door 17 includes a generally planar upper cover surface 21 which curves downwardly, as at 22, at its outer end to complement and overlie one arcuate end wall 16 of base container portion 11. Opposed side walls 23 extend downwardly from the side periphery of cover surface 21 and when lunchbox 10 is in the closed position shown in FIG. 1, door side walls 23 are positioned outside of and otherwise overlie the tops of side walls 14 of base container portion 11. The outer ends of side walls 23 terminate as generally circular wings 24 which cooperate with hinge assembly 19 in a manner to be hereinafter described. The inner corners of cover surface 21 are interrupted, with downwardly directed walls 25 forming recesses having bottom surfaces 26. Lugs 27 extend from wall 25 along each recess bottom surface 26 to the inner end thereof. A channel 28, U-shaped in section, is formed at the inner end of cover surface 21 of door 17 and extends laterally across the entire inner end thereof following the contour of the inner edge of cover surface 21 including the recessed bottom surface 26.

Similarly, door 18 includes a generally planar upper cover surface 29 which curves downwardly, as at 30, at its outer end to complement and overlie one arcuate end wall 16 of base container portion 11. Opposed side walls 31 extend downwardly from the side periphery of cover surface 29 and when lunchbox 10 is in the closed position, door side walls 31 are positioned outside of and otherwise overlie the tops of side walls 14 of base container portion 11. The outer ends of side walls 31 terminate as generally circular wings 32 which cooperate with hinge assembly 20 in a manner to be hereinafter described. The inner corners of cover surface 29 are interrupted, with downwardly directed walls 33 forming recesses having bottom surfaces 34. Lugs 35 extend from wall 33 along each recess bottom surface 34 to the inner end thereof. A downwardly directed lip 36 Is formed at the inner end of cover surface 29 of door 18 and extends laterally across the entire inner end thereof.

Figure 3:
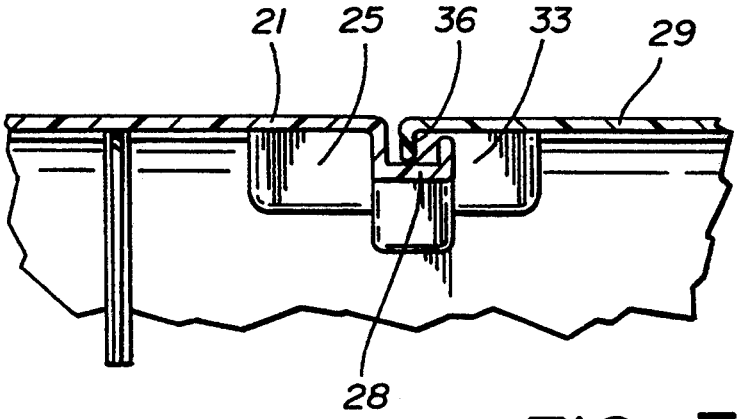
FIG. 3 is a fragmented sectional view taken substantially along line 3—3 of FIG. 1.

In order to close cover portion 12 on base container portion 11, door 17 is first rotated on its hinge assemblies 19 to the closed position with side walls 23 overlying base container portion side walls 14. Then door 18 may be rotated on its hinge assemblies 20 to the closed position with side walls 31 overlying base container portion side walls 14. As shown in FIG. 3, in this position, lip 36 of door 18 is positioned with channel 28 of door 17 such that door 17 cannot be opened without first opening door 18. In this position cover portion 12 may now be latched to base container portion 11 by latch assemblies indicated generally by the numeral 37 and now to be described.

A latch assembly 37 is provided on the outside of each side wall 14 of base container 11 generally centrally and near the top thereof. As probably best shown in FIG. 2, each latch assembly 37 includes a reinforcing web 38 integrally formed on each side wall 14. A hook member 39 having a slot therein is formed at the bottom of each web 38. Each latch assembly 37 also includes a latch body member 40, the bottoms of which having a slot 41 formed therein. To assemble each body member 40 onto base container side walls 14, the bottom of each latch body member 40 is snapped into the slot of the hook member 39 so that, as a latch body member 40 is rotated from the FIG. 2 to the FIG. 1 position, hook member 39 may extend through its slot 41. A tab 42 extends laterally from the other end of each latch body member 40 and has a protuberance 43 thereon which is adapted to engage lugs 27 and 35 of doors 17 and 18, respectively. Thus, when doors 17 and 18 are closed as previously described, lugs 27 and 35 are aligned and upon rotation of latch body member 40 from the FIG. 2 to the FIG. 1 position, protuberance 43 will engage both lugs 27 and 35 to maintain cover portion 12 closed and locked onto body portion 11. If one latch assembly 37 should become disengaged, the other latch assembly 37 will readily maintain the doors 17 and 18 closed. However, even if both latch assemblies 37 were open, because of the friction of hinge assemblies 19 and 20, the construction of which is now to be described, doors 17 and 18 cannot accidentally open but rather must be opened in sequence as previously described.

Hinge assemblies 19 and 20 are essentially identical with the exception that hinge assembly 20 accommodates and is otherwise integrally related to a handle member generally indicated by the numeral 44. Handle member 44 is generally U-shaped in configuration having a gripping portion 45 spanning between the outer ends of side arms 46. The inner end of each arm 46 is provided with a hoop 47 only partially shown in section in FIG. 4 which also depicts the construction of hinge assembly 20. While only a hinge assembly 20 will now be described in detail, it is to be understood that hinge assemblies 19 are essentially identical except for the fact that hinge assemblies 20 also accommodate, as previously described, handle member 44 whereas hinge assemblies 19 do not.

Figure 4:
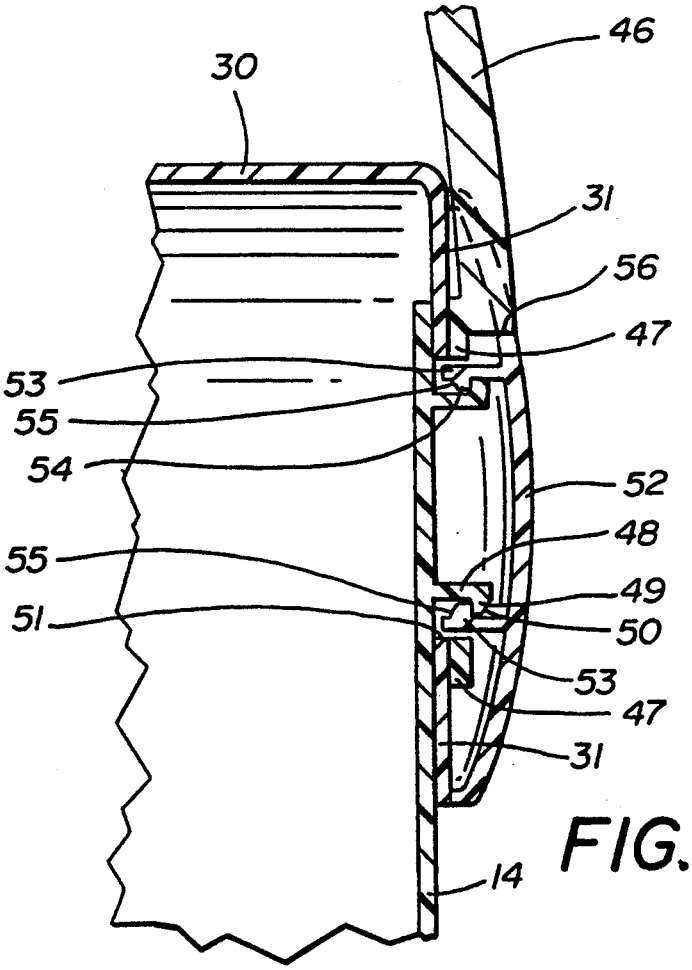
FIG. 4 is a fragmented sectional view taken substantially along line 4—4 of FIG. 1.

As shown in FIG. 4, base member side walls 14 have a generally circular post or hub 48 extending laterally outward therefrom near ends 15. The outer end of hub 48 is provided with a circular lock flange 49 having a bevelled surface 50 formed thereon. Hub 48 extends through an opening 51 formed in-wings 32 of side walls 31 of door 18. A button-like hinge cap 52 has a circular flange 53 extending inwardly therefrom, which flange includes a radially inwardly directed circular lug 54 having a bevelled surface 55 formed thereon. A slot 56 (FIG. 1) is cut into each hinge cap 52 to receive side arms 46 of handle member 44. Hoops 47, positioned at the bottom of arms 46, are received around flange 53.

Figure 2:
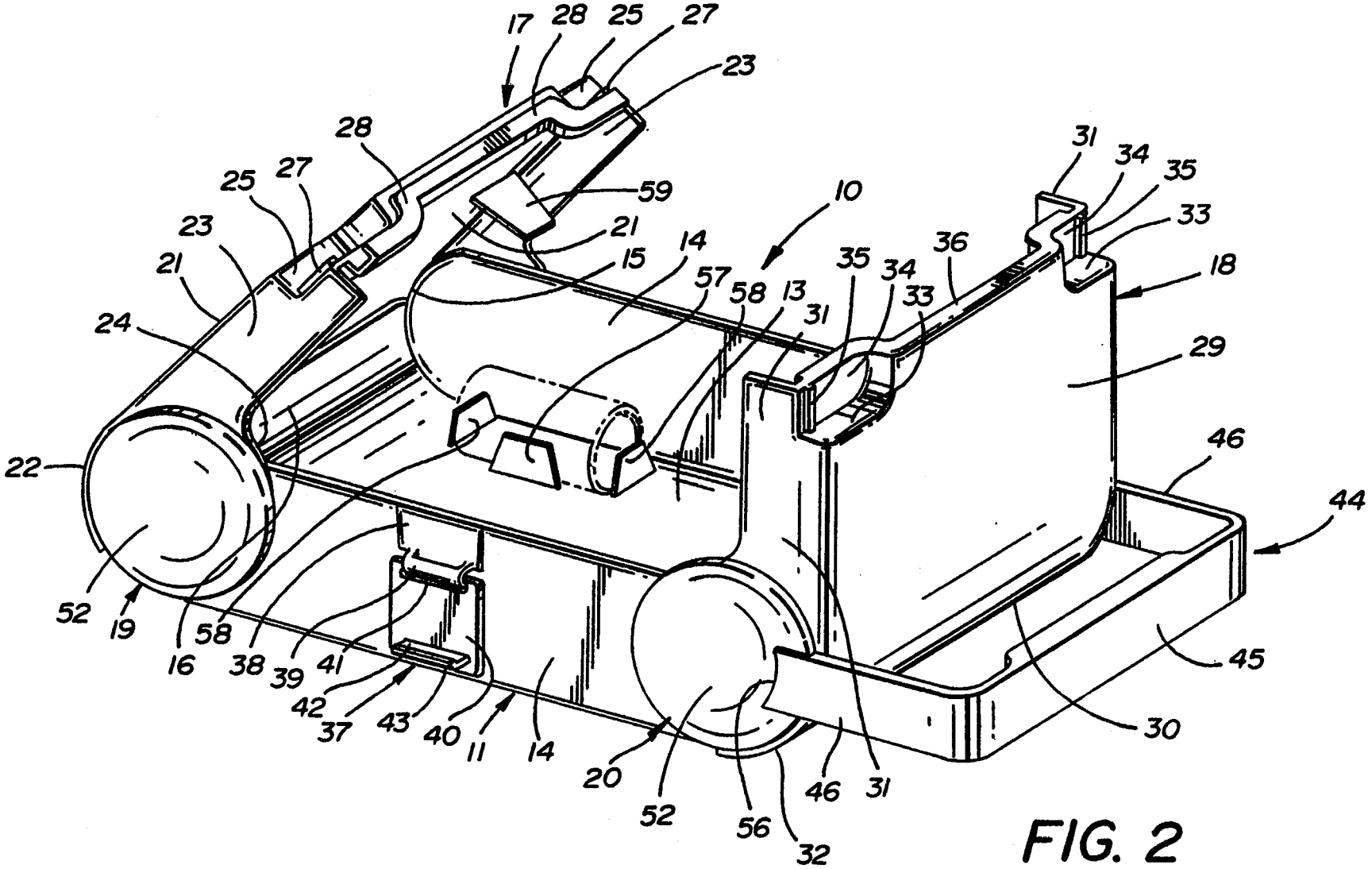
FIG. 2 is another perspective view of the lunchbox of FIG. 1 showing one door of the cover partially open and the other door essentially completely open.

Cap 52 is installed merely by pushing it toward the other components of hinge assembly 20. Thus, bevelled surface 55 of lug 54 rides on bevelled surface 50 of lock flange 49 and lug 54 flexes so that it may snap over hub 48 to the FIG. 4 position. Cap 52 thereby not only holds door 18 to base portion 12 but also confines handle member 44 on flange 53 and hub 48. When door 18 is opened, it rotates relative to hub 48 and base portion 12. When in the fully open position, such as door 18 is shown in FIG. 2, doors 17 and 18 can further serve to confine items in lunchbox 10 effectively serving as an upper end extension of side walls 14 of base container portion 11.

Handle member 44 too may be rotated, for example, from the upright position shown in FIG. 1 to a position where it would reside at the top or bottom of lunchbox 10 and by virtue of the fact that arms 46 extend through cap slots 56, caps 52 will rotate with handle member 44 around hub 48. Lunchbox 10 may be carried with handle member 44 in any alternative position in that the friction fit between lock flange 49 and lug 54 is such that handle member 44 will not rotate during normal carrying but rather it must be manually rotated to a new position, as desired, to overcome the friction fit. As previously indicated, hinge assemblies 19 for door 17 are identical except that handle member 44 is not present and cap 52 is not slotted unless, or course, it were desired to position a second handle member 44 on the other end of lunchbox 10.

Lunchbox 10 is also preferably designed so as to be able to securely hold food-related or other accessories. Thus, as shown in FIG. 2, tubular items such as a salt shaker, coin or key container or the like, shown in phantom, may be stored in lunchbox 10 without rolling around or otherwise moving within the lunchbox. To that end, a side tab 57 extends upwardly from bottom surface 13 to laterally confine the tubular member between it and a side wall 14. Opposed end tabs 58, also extending upwardly from bottom surface 13, can be provided to confine the tubular member from movement in the longitudinal or end-to-end direction of lunchbox 10. To maintain the tubular member at all times within the confines of tabs 57 and 58, a top tab 59 may be provided to extend downwardly from the door above the tubular member, in this instance cover surface 21 of door 17, so that when door 17 is closed and latched, the bottom of tab 59 rests upon the tubular member. Thus, the tubular member is confined from substantial movement in all directions. It should be appreciated that accessories of other configurations could be confined and held in place by similar hold-down features without departing from the spirit of this aspect of the present invention.

Based on the foregoing, it should now be clear that a lunchbox constructed in accordance with the concepts of the present invention accomplishes the objects of the invention and otherwise substantially improves the art.

I claim:

1. A container comprising a base container portion having a bottom surface and side walls extending generally laterally from said bottom surface to form an opening for the container, a cover portion for closing the opening, said cover portion including a first door and a second door, first hinge means attaching one end of said first door to one end of said side walls for rotation relative to said side walls, second hinge means attaching one end of said second door to the other end of said side walls for rotation relative to said side walls, latch means having one end pivotally mounted on said side walls, and lug means near the other end of said first and second doors to receive the other end of said latch means so that said cover portion may be maintained closed on said base container portion said lug means including a first lug member positioned in a recess near said other end of said first door and a second lug member positioned in a recess near said other end of said second door, said first and second lug members being aligned with each other to receive said other end of said latch means when said cover portion is closed on said base container portion.

2. A container according to claim 1 further comprising a channel formed at said other end of said first door and a lip formed at said other end of said second door, said lip being received in said channel when said cover portion is closed on said base container portion so that said second door must be pivoted on said second hinge means before said first door can be pivoted on said first hinge means.

3. A container according to claim 1 further comprising a handle member carried by one of said hinge means for rotation relative to said side walls and to one of said doors having said one of said hinge means.

4. A container according to claim 1, said base container portion including arcuate end walls, said one end of said doors also being arcuate and overlying said arcuate end walls.

5. A container according to claim 4, each said door including a generally planar surface extending from said one arcuate end, and side walls extending from said planar surface, said side walls of each said door overlying said side walls of said base container portion when said doors are closed on said base container portion.

6. A container comprising a base container portion having a bottom surface and side walls extending generally laterally from said bottom surface to form an opening for the container, a cover portion for closing the opening, said cover portion including a first door and a second door, first hinge means attaching one end of said first door to one end of said side walls for rotation relative to said side walls, second hinge means attaching one end of said second door to the other end of said side walls for rotation relative to said side walls, latch means having one end pivotally mounted on said side walls, lug means near the other end of said first and second doors to receive the other end of said latch means so that said cover portion may be maintained closed on said base container portion, and a handle member carried by one of said hinge means for rotation relative to said side walls and to one of said doors having said one of said hinge means, said handle member including side arms, a gripping portion spanning said side arms, and a hoop member carried by each said side arm, said hoop members being received by said hinge means.

7. A container comprising a base container portion having a bottom surface and side walls extending generally laterally from said bottom surface to form an opening for the container, a cover portion for closing the opening, said cover portion including a first door and a second door, first hinge means attaching one end of said first door to one end of said side walls for rotation relative to said side walls, second hinge means attaching one end of said second door to the other end of said side walls for rotation relative to said side walls, latch means having one end pivotally mounted on said side walls, and lug means near the other end of said first and second doors to receive the other end of said latch means so that said cover portion may be maintained closed on said base container portion, each said hinge means including a hinge assembly carried by each said side wall, each said hinge assembly including a hub member extending outwardly from each said side wall, a lock flange on said hub member, a hinge cap, a flange on said hinge cap, and a lug carried by said flange, said lug engaging said lock flange.

8. A container according to claim 7 wherein said lock flange and said lug include complementary bevelled surfaces.

9. A container according to claim 7 wherein said caps of said hinge assemblies of at least one of said hinge means includes a slot, and further comprising a handle member received through said slot and around said hub member.

10. A container comprising a base container portion having a bottom surface and side walls extending generally laterally from said bottom surface to form an opening for the container, a cover portion for closing the opening, said cover portion including a first door and a second door, first hinge means attaching one end of said first door to one end of said side walls for rotation relative to said side walls, second hinge means attaching one end of said second door to the other end of said side walls for rotation relative to said side walls, latch means having one end pivotally mounted on said side walls, and lug means near the other end of said first and second doors to receive the other end of said latch means so that said cover portion may be maintained closed on said base container portion, said latch means including a hook member mounted on said side wall, a body member having one end connected to said hook member for pivotal movement relative thereto, and a protuberance on the other end of said body member to engage said lug means.

11. A container comprising a base container portion having a bottom surface and side walls extending generally laterally from said bottom surface to form an opening for the container, a cover portion for closing the opening, said cover portion including a first door and a second door, first hinge means attaching one end of said first door to one end of said side walls for rotation relative to said side walls, second hinge means attaching one end of said second door to the other end of said side walls for rotation relative to said side walls, latch means having one end pivotally mounted on said side walls, lug means near the other end of said first and second doors to receive the other end of said latch means so that said cover portion may be maintained closed on said base container portion, and means carried by said bottom surface and means carried by at least one of said doors cooperating with each other to confine an accessory within said base container portion.

12. A container according to claim 11 wherein said means to confine includes a first tab extending from said bottom surface and opposed to said side wall to confine the accessory therebetween in one direction, second tabs extending from said bottom surface and confining said accessory in a second direction generally laterally of the one direction, and a third tab extending from said one of said doors and confining the accessory in a third direction when said one of said doors is closed on said base container portion.

13. A container comprising a base container portion having a bottom surface and side walls extending generally laterally from said bottom surface to form an opening for the container, at least one door for closing the opening, hinge means attaching said door to said side walls for rotation relative to said side walls, a handle member carried by said hinge means for rotation relative to said side walls and said door, and means carried by said bottom surface and means carried by at least one of said doors cooperating with each other to confine an accessory within said base container portion.

14. A container according to claim 13 wherein said handle member includes side arms, a gripping portion spanning said side arms, and a hoop member carried by each said side arm, said hoop members being received by said hinge means.

15. A container according to claim 13 further comprising a second door, second hinge means attaching said second door to said side walls for rotation relative to said side walls, latch means having one end pivotally mounted on said side walls, and lug means on said doors to receive the other end of said latch means so that said doors may be maintained closed on said base container portion.

16. A container comprising a base container portion having a bottom surface and side walls extending generally laterally from said bottom surface to form an opening for the container, at least one door for closing the opening, hinge means attaching said door to said side walls for rotation relative to said side walls, and a handle member carried by said hinge means for rotation relative to said side walls and said door, said hinge means including a hinge assembly carried by each said side wall, each said hinge assembly including a hub member extending outwardly from each said side wall, a lock flange on said hub member, a hinge cap, a flange on said hinge cap, and a lug carried by said flange, said lug engaging said lock flange.

17. A container according to claim 16 wherein said lock flange and said lug include complementary bevelled surfaces.

18. A container according to claim 16 wherein said caps of said hinge assemblies include a slot, said handle member having an arm received in each said slot.

19. A container comprising a base container portion having a bottom surface and side walls extending generally laterally from said bottom surface to form an opening for the container, at least one door for closing the opening, hinge means attaching said door to said side walls for rotation relative to said side walls, and means extending from said bottom surface and means extending from said door cooperating with each other to confine an accessory within said base container portion.

20. A container according to claim 19 wherein said means to confine includes a first tab extending from said bottom surface and opposed to a said side wall to confine the accessory therebetween in one direction, second tabs extending from said bottom surface and confining said accessory in a second direction generally laterally of the one direction, and a third tab extending from said door and confining the accessory in a third direction when said door is closed on said base container portion.

21. A container according to claim 19 further comprising a handle member carried by said hinge means for rotation relative to said door.

22. A container according to claim 19 further comprising a second door, second hinge means attaching said second door to said side walls for rotation relative to said side walls, latch means having one end pivotally mounted on said side walls, and lug means on said doors to receive the other end of said latch means so that said doors may be maintained closed on said base container portion.

23. A container comprising a base container portion having a bottom surface and side walls extending generally laterally from said bottom surface to form an opening for the container, a first door and a second door for closing the opening, first hinge means attaching said first door to said side walls for rotation relative to said side walls, second hinge means attaching said second door to said side walls for rotation relative to said side walls, latch means pivotally mounted to said side walls and engaging said doors so that said doors may be maintained closed on said base container portion, handle means carried by at least one of said hinge means for rotation relative to said side walls, and means extending from said bottom surface and means extending from said door cooperating with each other to confine an accessory within said base container portion.

* * * * *